US010077515B2

(12) United States Patent
Tanaka

(10) Patent No.: US 10,077,515 B2
(45) Date of Patent: Sep. 18, 2018

(54) WRAPPING NET, AND MANUFACTURING METHOD FOR SAME

(71) Applicant: Matsuyama Keori Co., Ltd., Ichinomiya-shi, Aichi (JP)

(72) Inventor: Toshiaki Tanaka, Ichinomiya (JP)

(73) Assignee: MATSUYAMA KEORI CO., LTD., Aichi (JP)

( * ) Notice: Subject to any disclaimer, the term of this patent is extended or adjusted under 35 U.S.C. 154(b) by 259 days.

(21) Appl. No.: 14/783,398

(22) PCT Filed: Apr. 23, 2014

(86) PCT No.: PCT/JP2014/061361

§ 371 (c)(1),
(2) Date: Oct. 8, 2015

(87) PCT Pub. No.: WO2014/175300

PCT Pub. Date: Oct. 30, 2014

(65) Prior Publication Data

US 2016/0053417 A1 Feb. 25, 2016

(30) Foreign Application Priority Data

Apr. 26, 2013 (JP) ..... 2013-093805
Jul. 22, 2013 (JP) ..... 2013-151430

(51) Int. Cl.
*D04B 21/12* (2006.01)
*D04B 21/10* (2006.01)
*D04B 21/20* (2006.01)

(52) U.S. Cl.
CPC ..... *D04B 21/12* (2013.01); *D04B 21/10* (2013.01); *D04B 21/20* (2013.01); *D10B 2505/10* (2013.01)

(58) Field of Classification Search
CPC ..... D04B 21/12; D04B 21/10; D04B 21/20
See application file for complete search history.

(56) References Cited

U.S. PATENT DOCUMENTS 3,171,272 A * 3/1965 Frith ..... D04B 21/10 66/195
3,178,910 A * 4/1965 Hammerle ..... A22C 13/00 426/129

(Continued)

FOREIGN PATENT DOCUMENTS

JP 61-058522 A 3/1986
JP 2002-004245 A 1/2002

(Continued)

OTHER PUBLICATIONS

PCT/US2014/061361, International Search Report, English translation.

*Primary Examiner* — Danny Worrell
(74) *Attorney, Agent, or Firm* — Gavin J. Milczarek-Desai; Quarles & Brady LLP

(57) ABSTRACT

This is to provide a wrapping net which maintains the merits by wrapping with a wrapping net effective for conveying and storage, and, in which a removal operation of the wrapping net is easy, even when a residue of the wrapping net is migrated into a feed or a fermentation raw material, an effect on the livestock is a little or no trouble is caused in a fermentation apparatus. It comprises warp yarn groups aligned in parallel in a lengthwise direction of a knitted fabric form a plural number of independent chain stitches by continuous loops in the lengthwise direction thereof, respectively, and each loop of the independent chain stitches is connected to other loops of other independent chain stitches by weft to form a knitted fabric. In the knitted fabric, characteristic feature resides in that at least the weft comprises a cellulose-based fiber, and yarn strength of the warp is greater than yarn strength of the weft.

9 Claims, 3 Drawing Sheets

(56) References Cited

U.S. PATENT DOCUMENTS 3,251,201 A * 5/1966 Newman ..... B65B 25/067 66/192
3,513,668 A * 5/1970 Mintz ..... D04B 21/12 66/193
4,071,138 A * 1/1978 Wright ..... B65D 85/07 206/83.5
4,656,812 A 4/1987 Busse et al.
4,917,008 A * 4/1990 van den Wildenberg ..... A01F 15/0715 100/15
5,104,714 A * 4/1992 Leiber ..... D01D 5/426 206/442
5,215,191 A * 6/1993 Wright ..... B65D 85/08 206/442
5,397,612 A * 3/1995 Small ..... D04B 1/14 428/36.1
5,855,231 A * 1/1999 Mintz ..... A22C 13/00 138/118
6,305,875 B1 * 10/2001 Matsumoto ..... D04B 21/10 405/16
6,477,865 B1 * 11/2002 Matsumoto ..... D04B 21/02 66/195
6,521,551 B1 * 2/2003 Mass ..... D04B 21/12 206/410
6,706,376 B1 * 3/2004 Von Fransecky ..... D04B 21/10 428/212
7,024,893 B2 * 4/2006 Dort ..... D04B 21/12 66/195
7,188,494 B2 * 3/2007 Dort ..... D04B 21/12 66/195
7,247,359 B1 * 7/2007 Mercuri ..... A22C 13/00 138/118.1
7,687,122 B2 * 3/2010 Huckfeldt ..... A22C 13/00 426/105
9,174,395 B2 * 11/2015 Durie ..... B29C 70/885
9,574,289 B2 * 2/2017 Lieber ..... D04B 21/12
2003/0106347 A1 * 6/2003 Kost ..... D04B 21/12 66/195

FOREIGN PATENT DOCUMENTS

JP 2014-133965 A 7/2014
WO 1990/006686 A1 6/1990
WO WO 2012160403 A1 * 11/2012 ..... D04B 21/12

* cited by examiner

WRAPPING NET, AND MANUFACTURING METHOD FOR SAME

TECHNICAL FIELD

The present invention relates to a wrapping net used in agriculture and livestock industries, in particular, to a wrapping net to be used for storing and conveying pasture such as hay and straw, or plants cut for maintaining a bank of a river as a roll bale. The present invention also relates to a manufacturing method for these wrapping nets.

BACKGROUND ART

In the livestock industry, dried pasture in which pasture such as hay and straw harvested from summer to fall is dried, or ensilage in which the dried pasture had been subjected to lactic acid fermentation has heretofore been stored and utilized as a livestock feed in winter. For making hay or straw, etc., as the dried pasture or ensilage, hay or straw, etc., is firstly wound to a roll state by a roll baler machine, and molded to a cylindrical shape to form a roll bale. Next, the roll bale is covered by a wrapping net, etc., so as not to collapse the shape and allowed to stand for several days. Thereafter, the roll bale in a suitably dried state is strictly coated by a wrapping film on the wrapping net, and conveyed and stored.

When the thus stored pasture is used as a feed, the wrapping net and the wrapping film are removed, and the pasture is made a feed in an easily edible state using a stirrer. At this time, the removed wrapping net and wrapping film are disposed as industrial wastes.

Thus, the wrapping net is an optimum material not only for preventing from collapse of a roll bale, but also for drying of a pasture due to its high air permeability. On the other hand, the wrapping film is an optimum material not only for preventing permeation of air or moisture into the pasture, but also for improving strength of the roll bale. The method of wrapping the roll bale utilizing such a wrapping net and a wrapping film has been starting to spread throughout Japan including Hokkaido since it is suitable for conveyance and storage of the pasture.

On the other hand, in recent years, a business utilizing the hay or the straw, etc., not for a dried pasture or an ensilage, but for a fermentation raw material of bioethanol which is a carbon neutral fuel has been started. In addition, not only the hay or straw, plants cur for maintaining a bank of a river are also considered to be utilized as a fermentation raw material of bioethanol. Thus, when the hay or the straw, etc., is utilized as the fermentation raw material, it is effective to wind these in a roll state by a roll baler machine, mold to a cylindrical shaped roll bale and convey and store in a factory to be processed.

Wrapping machines shown in the following mentioned Patent Document 1 or the following mentioned Patent Document 2, etc., are apparatuses for carrying out wrapping of a roll bale by a wrapping film automatically and efficiently. On the other hand, in the wrapping with a wrapping net, these wrapping machines are also used.

PRIOR ART REFERENCES

Patent Documents

Patent Document 1: JP Hei.6-70631A
Patent Document 2: JP Patent No. 3,801,618C

SUMMARY OF THE INVENTION

Problems to be Solved by the Invention

By the way, a general-purpose synthetic resin such as a polyethylene, etc., has been used for the wrapping net or the wrapping film used in the wrapping machines of the above-mentioned Patent Document 1 or the above-mentioned Patent Document 2, etc. In addition, in the wrapping net, for example, slit yarn in which a polyethylene film has been cut in thin and long stripes has been used in the point of economy. This slit yarn is formed by a stretched high density polyethylene (HDPE) film for maintaining the physical properties (in particular, strength) of the wrapping net, and thus, elongation of the wrapping net is extremely little.

In the actual operation, for wrapping the roll bale with a wrapping net or a wrapping film, wrapping is carried out by applying a large tension thereto by a wrapping machine. Accordingly, a large tension is applied to the outer peripheral of the roll bale which has been wrapped by the wrapping net and the wrapping film and hardly and firmly fixed.

Thus, even when it is a wrapping by the wrapping net and the wrapping film which are effective for conveying and storage, when the roll bale is thereafter utilized as a feed, an operation of entangle the pasture is carried out by cutting and removing the wrapping net and the wrapping film. At that time, the wrapping film is a sheet state so that it can be easily handled and it can be easily removed. To the contrary, the wrapping net is wound on the roll bale where many slit yarns having small elongation are piled up with a large tension, so that there is a problem that removal thereof is difficultly carried out.

For example, a strong force is required for cutting and removing the wrapping net after removal of the wrapping film from the roll bale, but an accident that an operator erroneously hurt the body by a cutting tool frequently occurs. In addition, there occur an accident that uncut remnants of the wrapping net are found at the time of stirring the pasture, and an operator who attempts to remove it gets caught in the machine.

In addition, due to difficulty of the removal operation of the wrapping net, there was a problem that a part of the wrapping net to be removed was migrated into the feed for livestock. Thus, if a part of the wrapping net was migrated into the feed for livestock, there was a problem that livestock ate the wrapping net made of a synthetic resin with the feed, livestock became sick, or will die.

Further, a general-purpose synthetic resin such as a polyethylene, etc., is used as the wrapping net and wrapping film which has been removed as mentioned above. Accordingly, these materials must be disposed as industrial wastes, so that there was a problem that labor and treatment costs are high for an agriculture and livestock industry producer.

On the other hand, as a fermentation raw material for bioethanol, even when the hay or the straw, etc., or the plants cut for maintaining a bank of a river, etc., are made a roll bale and conveyed and stored, for carrying out the fermentation operation, an operation to entangle the hay or the straw, etc., by cutting and removing the wrapping net is similarly required. As mentioned above, a general-purpose synthetic resin such as a polyethylene, etc., has been used for the wrapping net. These general-purpose synthetic resins cannot be utilized as a fermentation raw material for bioethanol.

Difficulty in removal operation of the wrapping net is the same as in the case of the agriculture and livestock industry, there occurs a problem that a part of the wrapping net to be removed is migrated into a fermentation raw material of bioethanol. Thus, if the part of the wrapping net is migrated into the fermentation raw material of bioethanol, troubles that a fermenter clogs, or it is entangled with a mixing apparats are considered.

Thus, an object of the present invention is, to cope with the above-mentioned problems, provide a wrapping net which maintains the merits by wrapping with a wrapping net effective for conveying and storage, and, in which a removal operation of the wrapping net is easy, even when a residue of the wrapping net is migrated into a feed or a fermentation raw material, an effect on the livestock is a little or no trouble is caused in a fermentation apparatus. Further, another object of the present invention is to provide a manufacturing method for these wrapping nets.

Means to Solve the Invention

For solving the above-mentioned problems, the present inventor has intensively studied, and as a result, he has found that the above-mentioned objects can be accomplished by combining yarns comprising cellulose-based fiber as a raw material of the wrapping net by investigating the structure of the wrapping net, whereby the present invention has been accomplished.

That is, the wrapping net according to the present invention comprises, in accordance with the definition of claim 1, warp yarn groups which comprise a cellulose-based fiber aligned in parallel in a lengthwise direction of a knitted fabric form a plural number of independent chain stitches by continuous loops in the lengthwise direction of the knitted fabric, respectively, and each loop of the independent chain stitches is connected to other loops of other independent chain stitches by weft which comprises a cellulose-based fiber to form a knitted fabric.

Also, the present invention is, in accordance with the definition of claim 2, the wrapping net defined in claim 1, wherein yarn strength of the warp is greater than yarn strength of the weft.

Further, the present invention is, in accordance with the definition of claim 3, the wrapping net defined in claim 2, wherein the warp is doubled yarns in which two or more yarns of single yarns which are staple fiber spun yarn a count of which is 5 to 20 comprising cotton fibers are aligned in parallel without twisting the yarns, and the weft is a single yarn of a staple fiber spun yarn a count of which is 10 to 30 comprising cotton fibers.

Moreover, the present invention is, in accordance with the definition of claim 4, the wrapping net defined in claim 2, wherein the warp is plied yarns in which two or more yarns of single yarns which are staple fiber spun yarn a count of which is 5 to 20 comprising cotton fibers are twisted, and the weft is single yarn of a staple fiber spun yarn a count of which is 10 to 30 comprising cotton fibers.

Furthermore, a wrapping net according to the present invention comprises, in accordance with the definition of claim 5, warp yarn groups comprising a synthetic resin-based fiber aligned in parallel in a lengthwise direction of a knitted fabric form a plural number of independent chain stitches by continuous loops in the lengthwise direction of the knitted fabric, respectively, each loop of the independent chain stitches is connected to other loops of other independent chain stitches by weft comprising a cellulose-based fiber to form a knitted fabric, and yarn strength of the warp is greater than yarn strength of the weft.

Still further, the present invention is, in accordance with the definition of claim 6, the wrapping net defined in claim 5, wherein the warp is a slit yarn having a single yarn fineness of 200 to 2500 decitex in which a synthetic resin film is slit, and the weft is staple fiber spun yarns a count of which is 3 to 30 and comprises cotton fibers.

Also, the present invention is, in accordance with the definition of claim 7, the wrapping net defined in claim 6, wherein the warp comprises a biodegradable resin.

Further, the present invention is, in accordance with the definition of claim 8, the wrapping net defined in any one of claims 1 to 7, wherein the weft is inserted into the independent chain stitches at entangling points of a needle loop of the loops constituting the independent chain stitches by extending upward from a lower portion in the lengthwise direction of the knitted fabric and a sinker loop which is right above the loop of the above loop, and further, inserted into the other independent chain stitches at entangling points of a needle loop of the loops constituting the independent chain stitches by extending upward and the other independent chain stitches and a sinker loop which is right above the loop of the above loop, whereby the independent chain stitches and the other independent chain stitches adjacent thereto are connected to knit a knitted fabric.

Moreover, the present invention is, in accordance with the definition of claim 9, the wrapping net defined in claim 8, wherein the net is so knitted that a knitted fabric density is 0.5 to 20 course/2.54 cm and a distance between the independent chain stitches connected in the lengthwise direction of a knitted fabric and the other independent chain stitches adjacent thereto is 10 cm or less by a warp knitting machine.

Furthermore, the present invention is, in accordance with the definition of claim 9, the wrapping net defined in claim 8, wherein when a distance between the independent chain stitches of the knitted fabric connected in the lengthwise direction and the other independent chain stitches adjacent thereto is made A, and a length of a loop at elongation in respective independent chain stitches is made B, a value of an opening ratio C of the knitted fabric represented by C=A/B is within the range of 1 to 5.

Still further, a manufacturing method for the wrapping net according to the present invention is, in accordance with an embodiment, a manufacturing method for a wrapping net which comprises continuously knitting the wrapping net defined in claims 1 to 9 by using a warp knitting machine equipped with a warp delivery mechanism, a weft feeding mechanism, a patterning mechanism, a stitches-forming mechanism and a winding mechanism, and when the wrapping net continuously knitting from the stitches-forming mechanism is wound by a winding roller of the winding mechanism, the winding roller is subjected to reciprocal movement in a rotation axis direction with a predetermined amplitude.

Effects of the Invention

According to the constitution of the above-mentioned claim 1, the wrapping net according to the present invention comprises a knitted fabric knitted by a warp and a weft both made of a cellulose-based fiber. The warp forms a plural number of independent chain stitches extending in the lengthwise direction of a knitted fabric. On the other hand, the weft forms a knitted fabric by connecting each loop of the independent chain stitches and other loop of the other independent chain stitches.

Thus, since both of the warp and the weft comprise a cellulose-based fiber, even if the livestock eats a part of the wrapping net comprising a cellulose-based fiber with a feed, which is the similar component to the hay or the straw, etc., and digested in a body of the livestock whereby there is no bad effect on the livestock. Also, even when a part of the wrapping net comprising a cellulose-based fiber is entered into a fermentation apparatus by migrated into a fermentation raw material, these become a fermentation raw material of bioethanol by being decomposed similarly to the hay or the straw, etc. Further, without removing the wrapping net from the roll bale, the wrapping net is finely cut with the roll bale and the whole of them can be used as a feed for the livestock or utilized as a fermentation raw material.

Also, according to the constitution of the above-mentioned claim 2, yarn strength of the warp is greater than yarn strength of the weft. According to this constitution, when the wrapping net after use is to be removed, the weft having weak yarn strength is predominantly cut, whereby the removal operation of the wrapping net becomes easy. Accordingly, no accident that an operator erroneously hurt the body by a cutting tool occurs.

Further, according to the constitution of the above-mentioned claim 3, the warp may be made doubled yarns in which two or more yarns of single yarns which are staple fiber spun yarn a count of which is 5 to 20 comprising cotton fibers are aligned in parallel without twisting the yarns, and the weft may be made single yarns of staple fiber spun yarn a count of which is 10 to 30 comprising cotton fibers. According to this constitution, when the wrapping net after use is to be removed, the weft having weak yarn strength is predominantly cut, whereby the removal operation of the wrapping net becomes easy.

Further, the present invention is, in accordance with the definition of claim 3, the wrapping net defined in claim 2, wherein the warp is doubled yarns in which two or more yarns of single yarns which are staple fiber spun yarn a count of which is 5 to 20 comprising cotton fibers are aligned in parallel without twisting the yarns, and the weft is a single yarn of a staple fiber spun yarn a count of which is 10 to 30 comprising cotton fibers.

Moreover, according to the constitution of the above-mentioned claim 4, the warp may be made plied yarns in which two or more yarns of single yarns which are staple fiber spun yarn a count of which is 5 to 20 comprising cotton fibers are twisted, and the weft may be made single yarns of staple fiber spun yarn a count of which is 10 to 30 comprising cotton fibers. According to this constitution, when the wrapping net after use is to be removed, the weft having weak yarn strength is predominantly cut, whereby the removal operation of the wrapping net becomes easy.

Furthermore, according to the constitution of the above-mentioned claim 5, the wrapping net according to the present invention is different from the constitution of the above-mentioned claim 1, and comprises a knitted fabric knitted by a warp comprising a synthetic resin-based fiber and a weft comprising a cellulose-based fiber. The warp forms a plural number of independent chain stitches extending in the lengthwise direction of the knitted fabric. On the other hand, the weft forms the knitted fabric by connecting the respective loops of the independent chain stitches and the other loops of the other independent chain stitches. Further, in the knitted fabric, the characteristic feature resides in that the yarn strength of the warp is greater than the yarn strength of the weft.

According to this constitution, when the wrapping net after use is to be removed, only the weft having weak yarn strength is cut, whereby the removal operation of the wrapping net becomes easy. Accordingly, no accident that an operator erroneously hurt the body by a cutting tool occurs.

Also, according to the constitution of the above-mentioned claim 6, the warp may be made slit yarns having a single yarn fineness of 200 to 2,500 decitex and comprising a synthetic resin film being slit, and the weft may be made staple fiber spun yarns a count of which is 3 to 50 comprising cotton fibers. According to this constitution, when the wrapping net after use is to be removed, only the weft having weak yarn strength is cut, whereby the removal operation of the wrapping net becomes easy.

Further, according to the constitution of the above-mentioned claim 7, the synthetic resin-based fiber of the warp may be made a biodegradable resin. The weft comprises the cellulose-based fiber, and has biodegradability. According to this constitution, since both of the warp and the weft have biodegradability, labor and the processing cost when the wrapping net is disposed by the agriculture and livestock raiser can be reduced.

Moreover, according to the constitution of the above-mentioned claim 8, a knitted texture of the wrapping net may be so constituted that the weft may be inserted into the independent chain stitches at entangling points of a needle loop of the loops constituting the independent chain stitches by extending upward from a lower portion in the lengthwise direction of the knitted fabric and a sinker loop which is right above the loop of the above loop. Further, the weft may be inserted into the other independent chain stitches at entangling points of a needle loop of the loops constituting the independent chain stitches by extending upward and the other independent chain stitches and a sinker loop which is right above the loop of the above loop.

According to this constitution, the independent chain stitches and the other independent chain stitches adjacent thereto are connected to knit a knitted fabric, and at the time of the removal operation of the wrapping net, the weft having weak yarn strength alone is cut whereby the removal operation of the respective independent chain stitches becomes easier.

Furthermore, according to the constitution of the above-mentioned claim 9, knitting of the wrapping net may be so carried out by a warp knitting machine that a knitted fabric density is 0.5 to 20 course/2.54 cm, and a distance between the independent chain stitches and the other independent chain stitches adjacent thereto is 10 cm or less. According to this constitution, while maintaining the merits of the wrapping net effective for conveying and storage, the removal operation of the wrapping net becomes easy.

Also, according to the constitution of the above-mentioned claim 9, when a distance between the independent chain stitches connecting in the lengthwise direction of the knitted fabric and the other independent chain stitches adjacent thereto is made A, and in the respective independent chain stitches, when a length at the time of elongation of one loop is made B, a value of the opening ratio C of the knitted fabric represented by $C=A/B$ may be set within the range of 1 to 5. When the value of the opening ratio C is within the range of 1 to 5, a shape of an opening portion of the knitted fabric becomes in the state of a square shape or a horizontally long rectangular shape in the lengthwise direction of the knitted fabric. According to this constitution, a degree of freedom of the knitted fabric became large in the warp direction, whereby stretchability of the wrapping net in the warp direction is improved, and the wrapping operation and the removal operation of the wrapping net become easy.

Further, according to the constitution of the above-mentioned claim 9, a manufacturing method for the wrapping net according to the present invention comprises using a warp knitting machine equipped with a warp delivery mechanism, a weft feeding mechanism, a patterning mechanism, a stitches-forming mechanism and a winding mechanism, to carry out continuously construction. Also, in the manufacturing method, when the wrapping net continuously knitted from the stitches-forming mechanism is wound by the winding roller of the winding mechanism, the winding roller is subjected to reciprocal movement in a rotation axis direction with a predetermined amplitude.

As mentioned above, the wrapping net according to the present invention comprises a knitted fabric knitted by using a cellulose-based fiber or a synthetic resin-based fiber for the warp, and a cellulose-based fiber for the weft. In particular, when the yarn strength of the warp is made stronger as compared to that of the weft, the warp becomes sometimes thick as compared to the slit yarn of the conventional polyethylene film.

Thus, when the thickness of the warp and that of the weft are greatly different from each other, if it is would in a roll state with the same diameter as the conventional ones (which is 25 cm or less due to restrictions of an apparatus), a length of the wrapping net which can be would to one roll becomes short. Thus, by making a winding roller a reciprocal movement in a rotation axis direction with a predetermined amplitude, the position of the warp to be would is always changed and never overlapped, whereby the long wrapping net can be wound to a roll.

Therefore, according to the present invention, a wrapping net which maintains the merits by wrapping with a wrapping net effective for conveying and storage, and, in which a removal operation of the wrapping net is easy, even when a residue of the wrapping net is migrated into a feed or a fermentation raw material, an effect on the livestock is a little or no trouble is caused in a fermentation apparatus can be provided. Further, the present invention can provide a manufacturing method for these wrapping nets.

EMBODIMENTS TO CARRY OUT THE INVENTION

Figure 1:
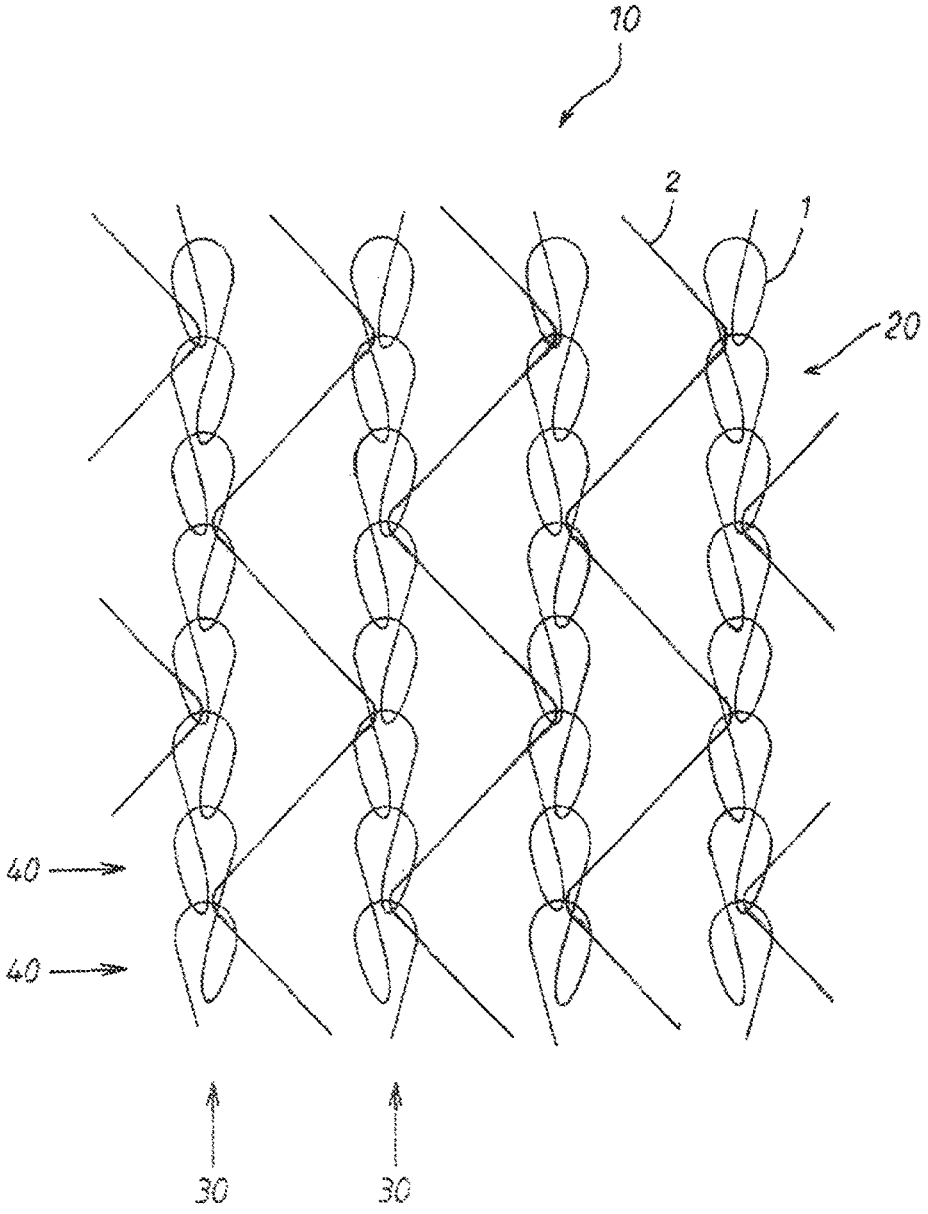
FIG. 1 is a schematic drawing showing a knitted texture which is one embodiment of the wrapping net according to the present invention.

In the following, the wrapping net according to the present invention is explained in detail by the respective embodiments. Incidentally, the present invention is not limited only by the following mentioned respective embodiments.

<<First Embodiment>>

In this first embodiment, a wrapping net knitted by a warp and a weft comprising cellulose-based fibers is explained. In this first embodiment, the cellulose-based fibers to be used for the warp and the weft may be mentioned natural cellulose-based fibers such as cotton, hemp, etc., and regenerated cellulose-based fibers such as rayon, cupra, polynosic or tensel, etc. Incidentally, as the hemp fibers, there may be mentioned flax (linen), China grass (ramie), cannabis (hemp), burlap (jute), etc.

In this first embodiment, since both of the warp and the weft comprise cellulose-based fibers, even when a part of the wrapping net is erroneously migrated into the hay or the straw, etc., at the time of removing the wrapping net from the roll bale, an effect to the livestock is a little or no trouble is caused in a fermentation apparatus.

That is, when the roll bale is utilized as a feed for the livestock, even if the livestock eats a part of the wrapping net comprising a cellulose-based fiber with a feed, which is the similar component to the hay or the straw, etc., and digested in a body of the livestock whereby there is no bad effect on the livestock. Also, when the roll bale is to be utilized as a fermentation raw material of bioethanol, even when a part of the wrapping net comprising a cellulose-based fiber is entered into a fermentation apparatus by migrated into a fermentation raw material, these become a fermentation raw material of bioethanol by being decomposed similarly to the hay or the straw, etc. Further, without removing the wrapping net from the roll bale, the wrapping net is finely cut with the roll bale and the whole of them can be used as a feed for the livestock or utilized as a fermentation raw material.

In addition, since both of the warp and the weft comprise cellulose-based fibers, the wrapping net removed from the roll bale can be disposed by burying in the soil as such. Or else, even when the wrapping net after use is subjected to incineration, it is carbon neutral as compared to the conventional synthetic resin fibers, and does not newly discharge $CO_2$. Accordingly, labor and the processing cost when the wrapping net after use is to be disposed, and influence on an environment can be reduced.

Incidentally, in this first embodiment, among the above-mentioned cellulose-based fibers, natural cellulose-based fibers are preferably used, and further, cotton fibers are particularly preferably used. This is because the cotton fibers are general-purpose fibers, and spun yarns with various thicknesses can be obtained easily at a low cost.

In this first embodiment, when yarns comprising cotton fibers are used for the warp, thick count single yarns may be used as such or two or more of single yarns from medium count to thick count may be used in combination. For example, when two or more single yarns of cotton fibers are used in combination, two or more single yarns which are staple fiber spun yarn a count of which is 5 to 20 may be used as doubled yarns aligned without twisting the yarns. Also, it may be used as plied yarns in which two or more single yarns of staple fiber spun yarn a count of which is 5 to 20 are twisted.

In this first embodiment, it is preferred to make doubled yarns or plied yarns in which two or more cotton spun yarns a count of which is 5 to 20 are combined. Also, the reason why cotton spun yarns a count of which is 5 to 20 are used as the single yarns is that these yarns are thick, yarn strength is strong, and commercially available in the market as low-cost general-purpose yarns and easily available. Further, the reason why the doubled yarns or the plied yarns are used for the warp, yarn strength of the thick yarns is made further stronger, and the difference in the yarn strength from that of the weft mentioned later is made large. Incidentally, a degree of twisting of the cotton spun yarns of the single yarns may be optionally selected depending on yarn strength and elongation.

Here, the doubled yarns mean yarns using two or more yarns aligned in parallel without twisting. In the case of the doubled yarns, two or more yarns are used aligned in parallel, it becomes yarns excellent in yarn strength. On the other hand, the plied yarns mean yarns in which two or more yarns are aligned in parallel and twisted. In the case of the plied yarns, two or more yarns are twisted, so that it becomes yarns excellent in yarn strength more than the doubled yarns. The plied yarns in which two yarns are twisted are called a two-plied yarn, and the plied yarns in which three yarns are twisted are called a three-plied yarn. In general, the two-plied yarn or the three-plied yarn is twisted to the direction opposite to the twisting of the single yarn. The twisting of the single yarn is said to be a first twist, and the twisting of the two-plied yarn or the three-plied yarn is said to be a final twist. Incidentally, a degree of the final twist of the plied yarns may be optionally selected depending on yarn strength and elongation.

On the other hand, in this first embodiment, when the yarns comprising cotton fibers are used for the weft, single yarns comprising cotton spun yarns a count of which is 10 to 30 are preferably used. This is because the cotton spun yarns a count of which is 10 to 30 are also commercially available in the market as low-cost general-purpose yarns and easily available. The reason why the single yarns are used for the weft is to make the difference in yarn strength from that of the above-mentioned warp large. Incidentally, a degree of twisting of the cotton spun yarn may be optionally selected depending on yarn strength and elongation.

Also, this is because if the cotton spun yarns used for the weft are thicker than a count of 10, yarn strength becomes large, and difference in yarn strength from the warp comprising the plied yarns becomes small, whereby the effects of the present invention cannot be exhibited. On the other hand, if the cotton spun yarns are thinner than a count of 30, yarn strength is small, it becomes difficult to maintain the shape of the wrapping net, and further a cost of the yarn becomes expensive.

In this first embodiment, yarn strength of the warp is required to be larger than yarn strength of the weft. According to this constitution, when the wrapping net after use is to be removed, the weft having weak yarn strength is predominantly cut, whereby the removal operation of the wrapping net becomes easy. Accordingly, no accident that an operator erroneously hurt the body by a cutting tool occurs.

Here, when both of the warp and the weft comprise yarns comprising cotton fibers as mentioned above, it is preferred that the doubled yarns or the plied yarns in which yarn strength of the single yarn which is from the medium count to the thick count is strengthened are used for the warp, while the single yarn is used for the weft whereby the difference between yarn strengths of the warp and the weft is made large. According to this constitution, even when the cotton spun yarns are used for the warp and the weft, the weft having weak yarn strength is predominantly cut, whereby the removal operation of the wrapping net becomes easy.

Here, the reason why the yarn strength of the weft is made smaller than the yarn strength of the warp is further explained in detail. As the physical property at the time of using the wrapping net, strength of the knitted fabric in the lengthwise direction is maintained by the warp, and connection in the lateral direction is maintained by the weft (knitting is mentioned later). Accordingly, to firmly fix the periphery of the roll bale after wrapping is yarn strength of the warp, so that the weft is not required to have yarn strength as that of the warp.

The reason why the conventional wrapping net uses the same yarns for the warp and the weft is that the manufacture thereof is easy and simple and kitting can be carried out with a low cost. To the contrary, in this first embodiment, yarns having smaller yarn strength than that of the warp are used for the weft to differentiate the yarn strengths between the warp and the weft. According to this constitution, in the removal operation of the wrapping net after use, when the warp having larger yarn strength is separated from the roll bale, the weft having smaller yarn strength connected thereto is cut.

When the weft is cut, the wrapping net becomes a state (knitting is mentioned later) of independent chain stitches comprising the warp having larger yarn strength. These independent chain stitches are the same as a rope shape and can be easily removed from the roll bale. According to this constitution, the removal operation of the wrapping net becomes easy, and no accident that an operator erroneously hurt the body by a cutting tool occurs.

On the other hand, many of the wefts cut by the removal operation are removed accompanied by the warp of the independent chain stitches. However, a part of the weft is migrated into the dried pasture or the ensilage of the roll bale as a residue. However, these residues comprise cellulose-based fibers which are the similar components to the hay or the straw, etc., and digested in a body of the livestock whereby there is no bad effect on the livestock. When the roll bale is to be utilized as a fermentation raw material of bioethanol, even when a part of the wrapping net comprising a cellulose-based fiber is entered into a fermentation apparatus by migrated into a fermentation raw material, these become a fermentation raw material of bioethanol by being decomposed similarly to the hay or the straw, etc. Further, without removing the wrapping net from the roll bale, the wrapping net is finely cut with the roll bale and the whole of them can be used as a feed for the livestock or utilized as a fermentation raw material.

Next, a knitted texture constituting the wrapping net according to this first embodiment is explained. Incidentally, the knitted texture of the wrapping net explained in this first embodiment relates not only to this first embodiment, but is common in the present invention. In this first embodiment, the wrapping net is a warp knitted net knitted by a warp knitting machine using the warp and the weft comprising the above-mentioned two kinds of the cellulose-based fibers. Here, the warp knitting means a knitting method in which a warp yarn group aligned in parallel in the lengthwise direction of a knitted fabric forms stitches (loops) continuously in the lengthwise direction of the knitted fabric, and generally characterized in having large strength in the lengthwise direction of the knitted fabric.

As the knitted texture of the warp knitting, there are various kinds of knitted textures based on a basic structure such as single denbigh, single cord, single atlas, chain stitch (chain stitching), etc., and in this first embodiment, chain stitch is employed among these. The wrapping net according to this first embodiment is required to constitute chain stitch (chain stitching) by the warp comprising a cellulose-based fiber, and to be made a knitted fabric in which the weft comprising a cellulose-based fiber is inserted into the chain stitch (chain stitching). This is because in the knitted texture other than the chain stitch, each chain stitch is connected to the warp, and in the removal operation of the wrapping net after use, the connected portion cannot be cut and the removal operation becomes difficult.

Also, as the warp knitting machine, there are a raschel knitting machine, a tricot knitting machine, etc. In this first embodiment, any knitting machine may be used, and in general, a raschel knitting machine is preferably used in the point of productivity, etc.

Here, knitting of the wrapping net according to this first embodiment is specifically explained. FIG. 1 is a schematic drawing showing a knitted texture of the wrapping net according to this first embodiment. In FIG. 1, the wrapping net (10) comprises the warp (1) comprising a cellulose-based fiber having strong yarn strength and the weft (2) comprising a cellulose-based fiber having weak yarn strength, and the warp (1) forms loops (20) which constitute a basis of the knitted fabric.

FIG. 1 shows a knitted fabric comprising chain stitches of 4 wales (ribs in the vertical direction)×8 course (ribs in the lateral direction). Each wale (30) and each course (40) form a wide and long knitted fabric by further knitting in the vertical and lateral directions. In this FIG. 1, four warps (1) aligned in parallel in the vertical direction each form continuous loops (20) by extending upward in the drawing, and each form a wale (30) comprising independent chain stitches.

In this state, the wales (30) of the respective independent chain stitches are not connected to each other, and no knitted fabric is constituted. Thus, a warp knitted net is so knitted that the warp yarn group (1) comprising a cellulose-based fiber forms the wale (30) of the respective independent chain stitches, and the weft (2) comprising a cellulose-based fiber connects the respective loops (20) of the wale (30) and the other loops (20) of the other wale.

In FIG. 1, the weft (2) is extended upward in the drawing, and first, it extends upward through (pass through) the loops at entangling points of continuous two loops of the wale (a portion at which a needle loop which is projected upward of one loop, and a sinker loop which is projected downward at right above the loop are concatenated). Thereafter, the weft (2) extends further upward through these loops (pass through) at the entangling points of the continuous two loops of the other wale adjacent thereto. Thereafter, the weft (2) is, at the entangling points of the continuous two loops of the original wale adjacent thereto, further extended upward through these loops (pass through), and connects the respective wales by similarly extending thereafter.

Further, a knitted fabric density of the warp knitted net knitted by a warp knitting machine is preferably 0.5 to 20 course/2.54 cm, more preferably 1 to 10 course/2.54 cm. Moreover, a distance between the stitches of a knitted fabric connected in the lengthwise direction and the stitches adjacent thereto is preferably 10 cm or less, more preferably 5 cm or less. Incidentally, the distance between the stitches and the stitches may be any value if it can maintain physical properties as the wrapping net by adjusting the relation between each fineness and yarn strength of the warp and the weft to be knitted. It is possible to make it, for example, 2.5 cm or less to 0.5 mm or so.

By making the knitted fabric density of the wrapping net 0.5 to 20 course/2.54 cm, and the distance between the stitches connecting in the lengthwise direction of the knitted fabric and the stitches adjacent thereto 10 cm or less, the hay or the straw, etc., cut short does not drop from a network of the wrapping net, and has roughness with a certain extent so that the wrapping net having a small basis (a weight per a unit area) and good economical efficiency can be constituted. According to this constitution, while maintaining the merits of the wrapping net effective for conveying and storage, the removal operation of the wrapping net becomes easy.

Here, when the single yarns, the doubled yarns or the plied yarns comprising cotton spun yarns with thick count are used for the warp of the wrapping net, elongation of the warp itself is small, so that stretchability of the wrapping net in the warp direction (in the lengthwise direction of the knitted fabric) becomes sometimes small. When the stretchability of the wrapping net is small, operatability when the roll bale is subjected to wrapping and operatability when the wrapping net is removed become difficult. Thus, in this first embodiment, it is preferred to control the shape of the opening portion of the knitted fabric of the wrapping net.

That is, it is preferred that a value of the opening ratio which represents a shape of the opening portion of the knitted fabric of the warp knitted net knitted by a warp knitting machine is made within a predetermined range. Here, the opening ratio of the knitted fabric is represented by the ratio of an opening length (vertical side) in the vertical direction of an opening portion formed by the independent chain stitches comprising the warp and an opening length (lateral side) in the lateral direction of the opening portion formed by the weft. That is, when a distance (lateral side) between the independent chain stitches connecting in the lengthwise direction of the knitted fabric and the other independent chain stitches adjacent thereto is made A, and in the respective independent chain stitches, when a length (vertical side) at the time of elongation of one loop is made B, a value of the opening ratio C of the knitted fabric is represented by $C=A/B$.

In this first embodiment, the value of the opening ratio C is preferably within the range of 1 to 5, more preferably within the range of 1 to 3. When the value of the opening ratio C is 1, the shape of the opening portion of the knitted fabric is a square shape. Also, when the value of the opening ratio C is larger than 1, the shape of the opening portion of the knitted fabric becomes a horizontally long rectangular shape in the lengthwise direction of the knitted fabric. By being the shape at the opening portion of the knitted fabric in the state of a square shape or a horizontally long rectangular shape, a degree of freedom of the knitted fabric became large in the warp direction (in the lengthwise direction of the knitted fabric), and stretchability of the wrapping net in the warp direction is improved. According to this constitution, the wrapping operation and the removal operation of the wrapping net become easy.

Next, a manufacturing method for the wrapping net is explained. Incidentally, the manufacturing method for the wrapping net explained in this first embodiment relates not only to this first embodiment, but is common in the present invention. As a manufacturing apparatus of the wrapping net, as mentioned above, a usual warp knitting machine may be used. As the warp knitting machine, there are a raschel knitting machine, a tricot knitting machine, etc., and in this first embodiment, a raschel knitting machine is preferably used. These warp knitting machines are equipped with a warp delivery mechanism, a weft feeding mechanism, a patterning mechanism, a stitches-forming mechanism and a winding mechanism.

The warp delivery mechanism is a mechanism of delivering a plural number of warps which have been warped with a length necessary for forming the stitches and with appropriate tension. The weft feeding mechanism is a mechanism of feeding the weft necessary for forming the stitches with appropriate tension. The patterning mechanism is a mechanism of selecting a yarn-feeding knitting needle, and forms a knitted fabric by interlocking with a stitches-forming mechanism which controls motion of a reed and motion of the knitting needle. The winding mechanism is a mechanism of winding the knitted fabric formed by the stitches-forming mechanism to a winding roller with a constant speed.

In this first embodiment, when the single yarns, the doubled yarns or the plied yarns comprising cotton spun yarns with thick count are used for the warp of the wrapping net, a thickness of the warp is thick, so that a thickness of the knitted fabric is thick as compared with the wrapping net using the slit yarn of the conventional polyethylene film. According to this constitution, when the wrapping net with the same length as the wrapping net using the conventional slit yarn is would as one roll, a diameter of the one roll becomes larger.

On the other hand, the wrapping machine which has frequently been used at present is designed corresponding to the wrapping net using the conventional slit yarn. Accordingly, when the wrapping net using the single yarns, the doubled yarns or the plied yarns comprising cotton spun yarns with thick count are wound with the same length as that of the wrapping net using the conventional slit yarn, it cannot be mounted to the present wrapping machine.

Thus, it is employed a method by shortening the length of the wrapping net to be wound in one roll to make the diameter the same as the conventional ones. In general, the wrapping net using the conventional slit yarn is wound in one roll with a length of 1,000 m. To the contrary, for example, in the case of the wrapping net using the doubled yarns or the two-plied yarn comprising cotton spun yarn a count of which is 10, it cannot be would in one roll only 200 m or so. Thus, if the length of the wrapping net to be wound in one roll is shortened, an exchange operation of the wrapping net must be carried out frequently, whereby workability of the wrapping operation is markedly lowered.

Thus, in the manufacturing method of the wrapping net according to this first embodiment, for winding the wrapping net continuously knitted from a stitches-forming mechanism by a winding roller of a winding mechanism, the winding roller is subjected to reciprocal movement in a rotation axis direction with a predetermined amplitude. Also, in place of subjecting to reciprocal movement of the winding roller, a traversing apparatus may be provided before the winding roller, or a winding base may be moved, or these may be combined.

The wrapping net according to this first embodiment preferably has a distance between the independent chain stitches connecting in the lengthwise direction of the knitted fabric and the independent chain stitches adjacent thereto of 10 cm or less, more preferably 5 cm or less as mentioned above. Thus, by making the distance between the independent chain stitches adjacent thereto several cm, as compared with the thickness of the portion at which the independent chain stitches exist being thick, the thickness of the knitted fabric portion at which no independent chain stitches exist is not thick. Also, when the thicknesses of the warp and the weft are markedly different from each other (in general, the case where the warp is thick), the same matter occurs.

Thus, by subjecting the winding roller to reciprocal movement in a rotation axis direction with a predetermined amplitude (it is preferably the same or slightly narrow distance to that of the independent chain stitches and the independent chain stitches adjacent thereto), the portion of the independent chain stitches is uniformly split to right and left without overlapping, and even when it is would with the same diameter, a length of the wrapping net which can be wound in one roll can be elongated.

In addition, by making winding hardness at the time of winding to a roll hard, a length of the wrapping net which can be wound in one roll can be elongated. Here, as the winding hardness, for example, it is preferred to winding with the winding hardness of 50 g/cm$^2$ or more. As a method for hardening the winding hardness, it is preferably employed a method such as a method by a press roller, a method by a torque limit apparatus and a stepped roller, a tension device by a fixed three-rollers, or a combination of these methods.

Also, when the winding roller is subjected to reciprocal movement in a rotation axis direction with a predetermined amplitude, both ends (which are called as "ears" of the knitted fabric) of the wrapping net are disturbed, deficiencies sometimes occur in the hardness and uniformity of the winding. Thus, "a stay yarn" may be added to the independent chain stitches at the portion of the both ends (ears) of the wrapping net. This stay yarn reinforces the independent chain stitches without forming any loop, along the independent chain stitches of the both ends (ears) of the wrapping net.

According to these matter, even when the wrapping operation is carried out by using the conventional wrapping machine without modifying the same, an exchange operation of the roll becomes not so frequently, and workability of the wrapping operation is never lowered.

Next, the wrapping net according to this first embodiment is specifically explained by referring to Example 1 and Example 2. Incidentally, the present invention is not limited only by the following Examples.

EXAMPLE 1

In the present Example 1, as a warp comprising a cellulose-based fiber constituting a wrapping net, doubled yarns (10//2s) which uses two single yarns (10/-) a count of which is 10 comprising cotton spun yarn by arranging in parallel without twisting were used. Yarn strength (tensile strength) of this cotton doubled yarns (12//2s) was 14 N/1 thread. On the other hand, as a weft comprising a cellulose-based fiber constituting the wrapping net, a single yarn (20/-) a count of which is 20 comprising cotton spun yarn was used as the single yarn as such. Yarn strength (tensile strength) of this cotton single yarn (20/-) was 3 N/1 thread. Incidentally, measurements of the tensile strength-elongation of the yarn (tensile strength and elongation percentage) were carried out according to JIS-L1013.

In the present Example 1, a raschel knitting machine was used for knitting of the wrapping net, and a wrapping net of a knitted texture shown in the above-mentioned FIG. 1 was knitted (in FIG. 1, the warp is shown by one line for the sake of convenience, but is actually two threads of doubled yarns). A knitted fabric density of the wrapping net knitted in the present Example 1 was 2 course/2.54 cm, and a distance with the chain stitch (wale) adjacent to the chain stitch (wale) connecting to the knitted fabric in the lengthwise direction was 2.5 cm. Also, a basis weight of the wrapping net was 15 g/m$^2$. Incidentally, at the independent chain stitches of the both ends (ears) of the wrapping net, a stay yarn was so provided that it reinforces the independent chain stitches without forming a loop along the independent chain stitches. In the present Example 1, as the stay yarn, cotton spun yarns a count of which is 20 were used in the state of the single yarn as such.

The wrapping net according to the present Example 1 was knitted by the knitted texture shown in FIG. 1, each chain stitch (wale) was so formed by running the cotton doubled yarns (10//2s) which were the warp three times (1.5 round trips) per one loop, and thus, strength (tensile strength) per one chain stitch was 40 N/1 thread corresponding to about 3-fold of the yarn strength of the cotton doubled yarns (10//2s).

On the other hand, one weft responds to one chain stitch (see FIG. 1). From this constitution, one weft with 3 N/1 thread responds per one chain stitch with 40 N/1 thread, so that difference in yarn strengths between the warp and the weft becomes larger. According to this constitution, when the wrapping net after use is to be removed, the weft having weak yarn strength is predominantly cut, whereby the removal operation of the wrapping net becomes easy. Accordingly, no accident that an operator erroneously hurt the body by a cutting tool occurs.

Also, a knitted fabric density of the wrapping net according to the present Example 1 was 2 course/2.54 cm as mentioned above, and a distance with the chain stitch (wale) adjacent to the chain stitch (wale) connecting to the knitted fabric in the lengthwise direction was 2.5 cm. From the above constitution, a value of the opening ratio C which represents a shape of an opening portion of the wrapping net was as follows.

First, a distance (lateral side) between the chain stitches (wale) and the chain stitches (wale) adjacent thereto was A=2.5 cm, and a length (vertical side) at the time of elongation of one loop was B=2.54 cm/2=1.27 cm. Accordingly, the opening ratio of the wrapping net according to the present Example 1 was C=A/B=2.5/1.27=2. As a result, a shape of the opening portion of the wrapping net became a horizontally long rectangular shape in the lengthwise direction of the wrapping net, a degree of freedom of the knitted fabric became large in the warp direction (in the lengthwise direction of the knitted fabric), and stretchability of the wrapping net in the warp direction was good. According to this constitution, the wrapping operation and the removal operation of the wrapping net become easy.

On the other hand, in the present Example 1, for winding a wrapping net continuously knitting from a raschel knitting machine by a winding roller of a winding mechanism, the winding roller was subjected to reciprocal movement in a rotation axis direction with an amplitude of 2.5 cm. Also, a press roller corresponding to the winding roller is employed to make the winding hardness hard. By subjecting the winding roller to reciprocal movement in the rotation axis direction, the portion of the independent chain stitches was uniformly split to right and left without overlapping, and further the winding hardness was made 50 g/cm$^2$ or more by employing the press roller, a length of the wrapping net wound in one roll became 1,000 m/roll. At this time, a diameter of the wrapping net wound to a paper pipe having a diameter of 7.5 cm became 24 cm, and a winding hardness was 55 g/cm$^2$.

That is, as compared with the case of the wrapping net using the slit yarn of the conventional polyethylene film, the same length of the net could be wound by a roll having the same size of a diameter. According to this constitution, even when the wrapping operation is carried out by using the conventional wrapping machine, an exchange operation of the roll becomes not so frequently, and workability of the wrapping operation is never lowered.

By using the thus obtained wrapping net (a width: 1 m, a basis weight: 15 g/m$^2$) of the present Example 1, wrapping of the roll bale was actually carried out by using a wrapping machine. As a result, it could endure high tension of the apparatus which was similar to that of the conventional wrapping net (a high density polyethylene was used for both of the warp and the weft). Also, the surface of the roll bale subjected to wrapping has been wound with sufficiently hard, which could be satisfied practically. According to these constitutions, the merits of the wrapping net effective for conveying and storage can be maintained as in the conventional wrapping net.

Next, a removal operation of the wrapping net was carried out. In the wrapping net of the present Example 1, when the warp (actually chain stitch) having large yarn strength is separated from the roll bale, the weft having small yarn strength connecting thereto was suitably cut. Therefore, the wrapping net became a state of a chain stitch comprising a warp having large yarn strength, and could be easily removed from the roll bale. According to this constitution, the removal operation of the wrapping net becomes easy, and no accident that an operator erroneously hurt the body by a cutting tool occurs.

On the other hand, many of the weft cut by the removal operation were removed accompanied by the chain stitch comprising the warp, and the residue of the weft was substantially not migrated into the hay or the straw, etc., of the roll bale. However, even if the residue thereof is migrated into the hay or the straw, etc., the livestock can digest these, or they are utilized as a part of a fermentation raw material for bioethanol fermentation. Further, without removing the wrapping net from the roll bale, the wrapping net is finely cut with the roll bale and the whole of them can be used as a feed for the livestock or utilized as a fermentation raw material.

Here, when the wrapping net comprising the cotton fibers prepared in the present Example 1 was entered into a body of the livestock, whether these were digested with what an extent was confirmed by a digestion test. In the digestion test, the "Nylon bag method" which is to confirm digestion of a sample in the rumen of a cow was employed, and carried out at Livestock Technology Center of Hiroshima Prefectural Technology Research Institute.

First, the wrapping net of the present Example 1 comprising cotton fibers was charged in the Nylon bag, and the Nylon bag was charged into the rumen of a cow. After charging, each one bag was taken out after lapse of 1 day (24 hours), 2 days (48 hours), 3 days (72 hours), 4 days (96 hours), 5 days (120 hours) and 6 days (144 hours), washed in running water until the water became clear, and cryopreserved at −20° C. to immediately stop activity of the microorganism. Thereafter, the cryopreserved Nylon bag was thawed and washed with a household washing machine for 20 minutes in total by changing water every 5 minutes. These samples were dried by ventilation at 60° C. for 48 hours, and a weight of the content in the Nylon bag was weighed to calculate a dry material loss rate (reduced ratio %). Incidentally, digestion tests of foliage of a rice for a feed (Kusanohoshi) as Comparative example 1 and foliage of a rice for a feed (Tachisuzuka) as Comparative example 2 were simultaneously carried out.

Figure 2:
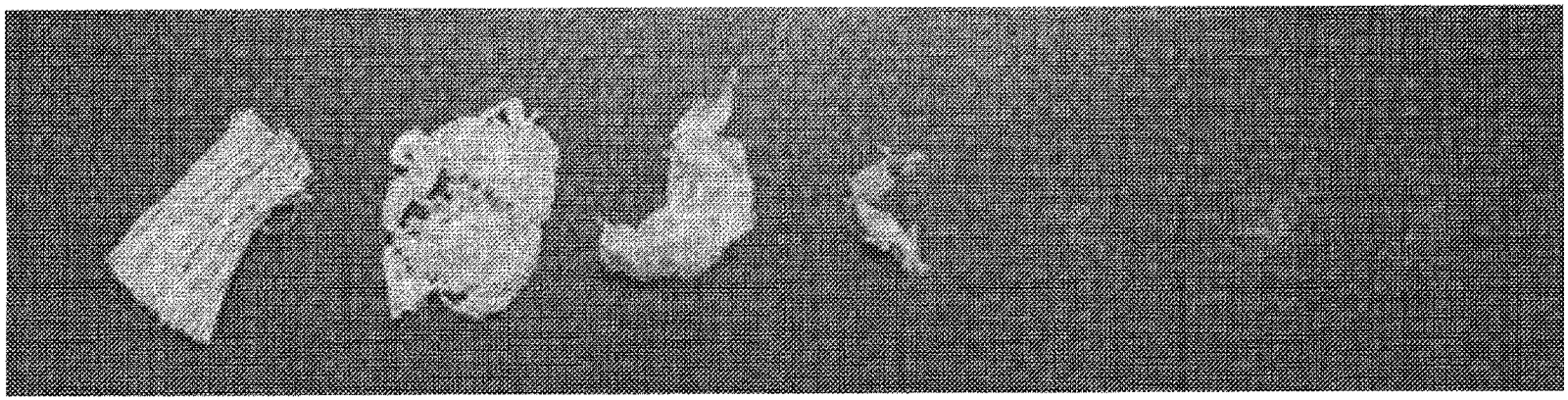
FIG. 2 is a photograph showing the result of a digestion test of the wrapping net comprising cotton fibers.
Figure 3:
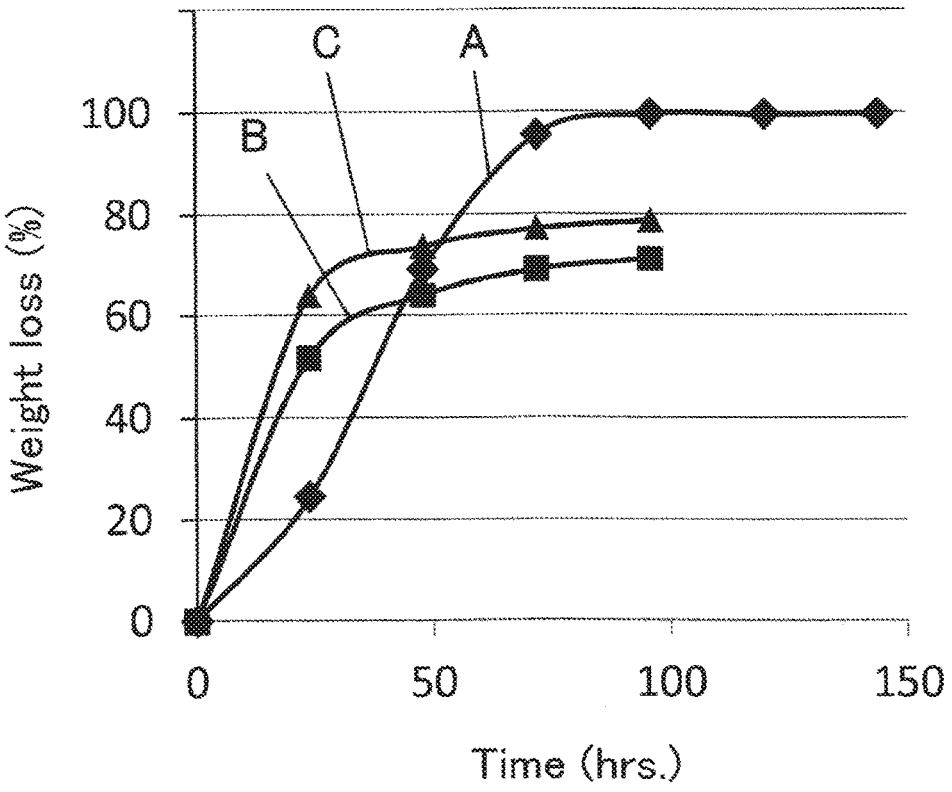
FIG. 3 is a graph in which the relation between the residence time and the weight reduction ratio in the digestion test of the wrapping net comprising cotton fibers is compared with the foliage of the rice for a feed.

The states of the respective samples of before the test (the residence time: 0 day) and after the test (the residence time: 1 day to 6 days) obtained by the digestion test by the Nylon bag method are shown by photographs in FIG. 2. Also, a relation between the residence time in the rumen and a dry material loss rate (reduced ratio %) in the digestion test of the wrapping net of the present Example 1 and those of Comparative example 1 and Comparative example 2 is shown in Table 1 and the graph of FIG. 3.

TABLE 1

| Residence time in the rumen | | Reduced ratio (%) | | |
|---|---|---|---|---|
| Day | Time | Example 1 | Comparative example 1 | Comparative example 2 |
| 0 | 0 | 0 | 0 | 0 |
| 1 | 24 | 24.4 | 51.8 | 63.9 |
| 2 | 48 | 69.1 | 63.9 | 73.6 |
| 3 | 72 | 95.3 | 69.0 | 77.1 |
| 4 | 96 | 99.5 | 71.0 | 78.7 |
| 5 | 120 | 99.5 | — | — |
| 6 | 144 | 99.6 | — | — |

From the photograph of FIG. 2, the wrapping net of the present Example 1 comprising cotton fibers becomes gradually small by digestion accompanied with a lapse of time of the residence time in the rumen of a cow. Also, it can be understood the process that the fibers were rapidly digested and disappeared after lapse of 3 days of the residence time. Further, as can be seen from Table 1 and FIG. 3, the wrapping net of the present Example 1 showed a small weight reduction ratio in the rumen of a cow with the residence time of 1 day, as compared with the foliage of the rice for a feed in Comparative examples 1 and 2. However, it can be understood that at the residence time of 2 days, the weight reduction ratio becomes the same degree as those of Comparative examples 1 and 2, and thereafter, reversed and the fibers are substantially digested at the residence time of 3 days.

According to this constitution, it can be understood that the wrapping net of the present Example 1 comprising cotton fibers can be digested similar to the foliage of the rice for a feed or more in the rumen of a cow. Accordingly, in the wrapping net according to this first embodiment, the wrapping net can be utilized the whole amount thereof as a feed for the livestock by finely cut with the roll bale or a fermentation raw material without removing from the roll bale.

EXAMPLE 2

In the present Example 2, as a warp comprising a cellulose-based fiber constituting a wrapping net, two-plied yarns (10/2) of plied yarns in which two cotton spun yarns a count of which is 10 have been aligned in parallel and twisted were used. Yarn strength (tensile strength) of this cotton two-plied yarn (10/2) was, 14 N/1 thread. On the other hand, as a weft comprising a cellulose-based fiber constituting the wrapping net, a single yarn (20/-) a count of which is 20 comprising cotton spun yarn was used as the single yarn as such. Yarn strength (tensile strength) of this cotton single yarn (20/-) was 3 N/1 thread. Incidentally, measurements of the tensile strength-elongation of the yarn (tensile strength and elongation percentage) were carried out according to JIS-L1013.

For knitting of the wrapping net in the present Example 2, a raschel knitting machine was used in the same manner as in the above-mentioned Example 1, and a wrapping net of a knitted texture shown in the above-mentioned FIG. 1 was knitted. A knitted fabric density of the wrapping net knitted in the present Example 2 was 2 course/2.54 cm, and a distance with the chain stitch (wale) adjacent to the chain stitch (wale) connecting to the knitted fabric in the lengthwise direction was 2.5 cm. Also, a basis weight of the wrapping net was 15 g/m$^2$. Incidentally, at the independent chain stitches of the both ends (ears) of the wrapping net, a stay yarn was so provided that it reinforces the independent chain stitches without forming a loop along the independent chain stitches. In the present Example 2, as the stay yarn, cotton spun yarns a count of which is 20 were used in the state of the single yarn as such.

The wrapping net according to the present Example 2 was knitted by the knitted texture shown in FIG. 1, each chain stitch (wale) was so formed by running the cotton two-plied yarns (10/2) which were the warp three times (1.5 round trips) per one loop, and thus, strength (tensile strength) per one chain stitch was 40 N/1 thread corresponding to about 3-fold of the yarn strength of the cotton two-plied yarns (10/2).

On the other hand, one weft responds to one chain stitch (see FIG. 1). From this constitution, one weft with 3 N/1 thread responds per one chain stitch with 40 N/1 thread, so that difference in yarn strengths between the warp and the weft becomes larger. According to this constitution, when the wrapping net after use is to be removed, the weft having weak yarn strength is predominantly cut, whereby the removal operation of the wrapping net becomes easy. Accordingly, no accident that an operator erroneously hurt the body by a cutting tool occurs.

Also, a knitted fabric density of the wrapping net according to the present Example 2 was 2 course/2.54 cm as mentioned above, and a distance with the chain stitch (wale) adjacent to the chain stitch (wale) connecting to the knitted fabric in the lengthwise direction was 2.5 cm. From the above constitution, a value of the opening ratio C which represents a shape of an opening portion of the wrapping net was as follows.

First, a distance (lateral side) between the chain stitches (wale) and the chain stitches (wale) adjacent thereto was A=2.5 cm, and a length (vertical side) at the time of elongation of one loop was B=2.54 cm/2=1.27 cm. Accordingly, the opening ratio of the wrapping net according to the present Example 2 was C=A/B=2.5/1.27=2. As a result, a shape of the opening portion of the wrapping net became a horizontally long rectangular shape in the lengthwise direction of the wrapping net, a degree of freedom of the knitted fabric became large in the warp direction (in the lengthwise direction of the knitted fabric), and stretchability of the wrapping net in the warp direction was good. According to this constitution, the wrapping operation and the removal operation of the wrapping net become easy.

On the other hand, in the present Example 2, for winding a wrapping net continuously knitting from a raschel knitting machine by a winding roller of a winding mechanism, the winding roller was subjected to reciprocal movement in a rotation axis direction with an amplitude of 2.5 cm in the same manner as in the above-mentioned Example 1. Also, a press roller corresponding to the winding roller is employed to make the winding hardness hard. By subjecting the winding roller to reciprocal movement in the rotation axis direction, the portion of the independent chain stitches is uniformly split to right and left without overlapping, and further the winding hardness was made 50 g/cm$^2$ or more by employing the press roller, a length of the wrapping net wound in one roll became 1,000 m/roll. At this time, a diameter of the wrapping net wound to a paper pipe having a diameter of 7.5 cm became 24 cm, and a winding hardness was 55 g/cm$^2$.

That is, as compared with the case of the wrapping net using the slit yarn of the conventional polyethylene film, the same length of the net could be wound by a roll having the same size of a diameter. According to this constitution, even when the wrapping operation is carried out by using the conventional wrapping machine, an exchange operation of the roll becomes not so frequently, and workability of the wrapping operation is never lowered.

By using the thus obtained wrapping net (a width: 1 m, a basis weight: 15 g/m$^2$) of the present Example 2, wrapping of the roll bale was actually carried out by using a wrapping machine. As a result, it could endure high tension of the apparatus which was similar to that of the conventional wrapping net (a high density polyethylene was used for both of the warp and the weft). Also, the surface of the roll bale subjected to wrapping has been wound with sufficiently hard, which could be satisfied practically. According to these constitutions, the merits of the wrapping net effective for conveying and storage can be maintained as in the conventional wrapping net.

Next, a removal operation of the wrapping net was carried out. In the wrapping net of the present Example 2, when the warp (actually chain stitch) having large yarn strength is separated from the roll bale, the weft having small yarn strength connecting thereto was suitably cut. Therefore, the wrapping net became a state of a chain stitch comprising a warp having large yarn strength, and could be easily removed from the roll bale. According to this constitution, the removal operation of the wrapping net becomes easy, and no accident that an operator erroneously hurt the body by a cutting tool occurs.

On the other hand, many of the weft cut by the removal operation were removed accompanied by the chain stitch comprising the warp, and the residue of the weft was substantially not migrated into the hay or the straw, etc., of the roll bale. However, even if the residue thereof is migrated into the hay or the straw, etc., the livestock can digest these, or they are utilized as a part of a fermentation raw material for bioethanol fermentation. Further, without removing the wrapping net from the roll bale, the wrapping net is finely cut with the roll bale and the whole of them can be used as a feed for the livestock or utilized as a fermentation raw material.

<<Second embodiment>>

In this second embodiment, a wrapping net knitted by the warp comprising a synthetic resin-based fiber and the weft comprising a cellulose-based fiber is explained. In this second embodiment, in the synthetic resin-based fiber to be used for the warp, fibers comprising a biodegradable resin are also included in addition to the fibers comprising usual synthetic resin-based fibers. This is because, by using the biodegradable resin, labor and the processing cost when the wrapping net after use is disposed can be reduced.

In this second embodiment, the usual synthetic resin to be used for the warp is not particularly limited, and a resin which has been generally used for a film or fibers and has versatility is preferred. It may be used a polyamide, a polyester, an acrylic-based, a high density polyethylene, a low density polyethylene, a polypropylene, a polyvinyl alcohol, a polyurethane, a polyvinyl chloride-based, an ethylene-vinyl acetate copolymerized product, etc.

In the conventional wrapping net, the same fibers are used for both of the warp and the weft, in particular, in the points of physical property (strength) and economy, a high density polyethylene (HDPE) which had widely been used in the field of agriculture and livestock has been used. In this second embodiment, a high density polyethylene (HDPE) similar to the conventional one can be also used as the warp. Also, in this second embodiment, a low density polyethylene (LDPE) excellent in stretchability and has good economical efficiency may be used as the warp. Here, the low density polyethylene (LDPE) is to include, in addition to the low density polyethylene (LDPE) by the usual high-pressure polymerization method, a linear low density polyethylene (LLDPE) which is a copolymerized product of an ethylene and other α-olefin(s).

Since the low density polyethylene (LDPE) generally has a low polymerization degree and has low crystallinity, it is inferior to the high density polyethylene (HDPE) in the point of yarn strength, but it can form a yarn having large elongation due to its low crystallinity. According to this constitution, when it is knitted to the wrapping net, an unconventional wrapping net having large stretchability can be constituted while maintaining the practical yarn strength.

On the other hand, the biodegradable resin to be used for the warp can be generally classified into a completely biodegradable resin and a partially biodegradable resin. In this second embodiment, either of the biodegradable resins can be used. First, the completely biodegradable resin means a resin which is decomposed by the action of a microorganism, and finally decomposed to water and carbon dioxide. There may be mentioned, for example, a polycaprolactone (PCL)-based, a polyethylene succinate (PES)-based, a polybutylene adipate (PBA)-based, a polybutylene succinate (PBS)-based, a polylactic acid (PLA)-based, a polyglycolic acid (PGA)-based, a polyhydroxy butyric acid (PHB)-based, acetyl cellulose, polyvinyl alcohol, etc.

Among these, in particular, with regard to the respective aliphatic polyester-based resins of a polylactic acid (PLA)-based, a polybutylene succinate (PBS)-based, a polycaprolactone (PCL)-based and a polyhydroxy butyric acid (PHB)-based, many investigations on microorganisms or enzymes which decompose the above resins have been done.

In particular, in this second embodiment, when the biodegradable resin is used for the warp, a polylactic acid (PLA)-based biodegradable resin is preferably used. This is because the biodegradable resin has excellent physical properties, and many researches on biodegradability have been done. The polylactic acid (PLA)-based biodegradable resin may be mentioned, for example, "ecodear" (Registered Trademark, available from Toray Industries, Inc.), etc.

Also, in this second embodiment, when the biodegradable resin is used for the warp, polybutylene succinate (PBS) or polybutylene succinate adipate (PBSA), which are a polybutylene succinate (PBS)-based biodegradable resin, is preferably used. Since these biodegradable resins have excellent physical properties similar to the polyethylene, and are most widely spread at the present moment. In addition, microorganisms or enzymes which decompose these biodegradable resins have been investigated in detail. The polybutylene succinate (PBS)-based biodegradable resin may be mentioned, for example, "Bionolle" (Registered Trademark, available from Showa Kobunshi K. K.), etc.

Contrary to the completely biodegradable resin, the partially biodegradable resin means a material in which a biodegradable component which is decomposed by the action of a microorganism is mixed and kneaded with a usual resin which does not have biodegradability as it is. In the partially biodegradable resin, the biodegradable component is firstly decomposed by the microorganism, and a resin whose molecular weight has been lowered remains. The remained resin is considered to be decomposed with a lapse of time.

In this second embodiment, the biodegradable component is not specifically limited so long as it is decomposed by an action of a microorganism, and further, those which is decomposed by an action of an enzyme, etc., derived from a microorganism are also included. As these biodegradable components, there may be preferably used, for example, a polysaccharide such as starch, cellulose, etc., a protein such as silk, wool, etc., and other natural polymer compounds.

In this second embodiment, the partially biodegradable resin may be mentioned, for example, polyethylene-based decomposable resin "Degralex" (Registered Trademark, available from Hitachi Chemical Filtec Inc.), etc. According to this article, it has been confirmed that a polyethylene whose molecular weight has been lowered after the biodegradable component has been decomposed is decomposed finally to water and carbon dioxide by the action of a microorganism (Hitachi Chemical Co., Ltd., Technical Report No. 45, 2005-7).

Further, in this second embodiment, as the biodegradable resin to be used for the warp, a material in which a biodegradable component is further mixed and kneaded with the above-mentioned completely biodegradable resin to improve a decomposition rate may be also utilized. For example, a material in which a solid grain having a predetermined grain diameter formed from rice is mixed with an aliphatic polyester resin which is a biodegradable resin has been proposed (JP Patent No. 4,264,468C).

Here, a shape of the synthetic resin-based fiber to be used as the warp is explained. As the synthetic resin-based fiber, any of monofilament yarn, multifilament yarn and staple fiber spun yarn may be used. The monofilament yarn means a continuous yarn comprising one single yarn, and a sectional shape of the monofilament yarn may be any shape, for example, it may be a circle, an ellipse, a triangle, a square, a rectangle, a rhombus and a cocoon shape, etc. Also, a manufacturing method for the monofilament yarn may be any method, and, for example, it may be melt spinning, wet spinning, dry spinning, or slit yarn in which a synthetic resin film is finely slit.

In this second embodiment, as the monofilament yarn to be used as the warp, slit yarn is preferably used in the points of physical property and economical efficiency. For example, as the above-mentioned synthetic resin, a high density polyethylene (HDPE) or a low density polyethylene resin (LDPE), or a polylactic acid (PLA) or a polybutylene succinate (PBS), etc., which is a biodegradable resin, is preferably used. In this case, these resins are firstly made a film by a T-die method or an inflation method. Next, the film is slit by a slitter with a predetermined width. At this time, the film may be optionally stretched before or after the slit, if necessary.

In this second embodiment, it is required that yarn strength of the warp is larger than yarn strength of the cellulose-based fiber to be used as the weft. Accordingly, a slit width (thickness of the slit yarn) and a degree of stretching of the slit yarn are adjusted depending on the physical property of the synthetic resin to be used.

Here, when the warp is a slit yarn, its single yarn fineness is preferably 200 to 2,500 decitex, more preferably 300 to 2,000 decitex. Further, it is most preferably 500 to 1,500 decitex. If the single yarn fineness of the slit yarn is 200 to 2,500 decitex, strength of the wrapping net after knitting, in particular, strength in the lengthwise direction of the knitted fabric can be maintained. According to this constitution, an outer peripheral of the roll bale after wrapping can be firmly fixed and the merits of wrapping by the wrapping net effective for conveying and storage can be maintained.

Further, when the warp is a slit yarn, yarn strength per one single yarn is preferably 5 to 60 N/1 thread, more preferably 7 to 50 N/1 thread. Further, it is most preferably 10 to 40 N/1 thread. If the yarn strength of the slit yarn per one single yarn is 5 to 60 N/1 thread, strength of the wrapping net after knitting, in particular, strength in the lengthwise direction of the knitted fabric can be maintained and an outer peripheral of the roll bale after wrapping can be firmly fixed. Further, by making the yarn strength of the warp larger than the yarn strength of the cellulose-based fiber to be used as the weft, the removal operation of the wrapping net after use becomes easy (details of the removal operation are mentioned later).

Further, the multifilament yarn means a continuous yarn in which a plural number of filament single fibers are doubled, and a sectional shape of the respective single fibers may be any shape. In addition, a manufacturing method for the multifilament yarn is generally carried out by a spinning process, and may be mentioned, for example, melt spinning, wet spinning, dry spinning, or may be fiber-splitting after spinning a composite yarn comprising single fibers like sea-island fibers. Moreover, the multifilament yarn may be twistless, or may be twisted so that the respective single fibers are not separated.

In this second embodiment, the multifilament yarn to be used as the warp is preferably manufactured by melt spinning in the points of physical property and economical efficiency. As the above-mentioned synthetic resin, it is preferred to use, for example, a high density polyethylene (HDPE) or a low density polyethylene resin (LDPE), or a polylactic acid (PLA) or a polybutylene succinate (PBS), etc., which is a biodegradable resin.

In this second embodiment, it is required that yarn strength of the warp is larger than yarn strength of the cellulose-based fiber to be used as the weft. Accordingly, single yarn fineness, a number of the filaments (thickness of the multifilament yarn) and a degree of stretching of the slit yarn are adjusted depending on the physical property of the synthetic resin to be used.

Also, the staple fiber spun yarn means a continuous yarn in which a plural number of short fibers are aligned in parallel and restrained by twisting, and is generally manufactured by a spinning process. In this second embodiment, the staple fiber spun yarn may be used as the warp in place of the above-mentioned monofilament yarn or multifilament yarn. In such a case, it is necessary to consider yarn strength and elongation of the yarn with the same degree as the above-mentioned monofilament yarn or multifilament yarn.

Next, the weft is explained. In this second embodiment, the cellulose-based fiber to be used for the weft may be mentioned a natural cellulose-based fiber such as cotton, hemp, etc., and a regenerated cellulose-based fiber such as rayon, cupra, polynosic or tensel, etc. Incidentally, the hemp fiber may be mentioned flax (linen), China grass (ramie), cannabis (hemp), burlap (jute), etc.

In this second embodiment, among these cellulose-based fibers, a natural cellulose-based fiber is preferably used, and cotton fiber is particularly preferably used. This is because the cotton fiber is a general-purpose fiber, and spun yarns with various thicknesses can be obtained with inexpensively and easily.

In the conventional wrapping net, as mentioned above, the same high density polyethylene (HDPE) as the warp is used for the weft. To the contrary, in this second embodiment, the characteristic feature resides in using different fibers in the warp and the weft. In particular, in this second embodiment, it is required that yarn strength of the warp is larger than yarn strength of the weft. Therefore, a synthetic fiber having large yarn strength is used for the warp, and a cellulose-based fiber having a relatively small yarn strength is used for the weft.

Here, when the weft is a spun yarn (cotton spun yarn) comprising a cotton fiber, the thickness thereof may be optionally selected in relation to the yarn strength of the warp, and in general, and a count of 3 to 30 is preferred, more preferably a count of 8 to 20. The cotton spun yarns a count of which is 3 to 30 are general-purpose use and can be obtained most inexpensively.

Also, if the cotton spun yarn is thicker than a count of 3, yarn strength becomes large, and the difference in the yarn strengths from that of the warp comprising a synthetic fiber become small, whereby the effects of the present invention cannot be exhibited. On the other hand, if the cotton spun yarn is thinner than a count of 30, yarn strength is small and it is difficult to maintain the shape of the wrapping net, and further, a cost of the yarns becomes expensive. Incidentally, a degree of twisting of the cotton spun yarn may be optionally selected depending on yarn strength and elongation.

Incidentally, in this second embodiment, the cotton single yarn may be used, and the two-plied yarn, etc., has a large yarn strength and expensive so that it cannot be said to be preferred. In addition, while the weft comprising the cotton fibers in the above-mentioned the first embodiment is preferably made a single yarn of the cotton spun yarns a count of which is 10 to 30, in this second embodiment, a range of a count of the yarn is wide and it can be preferably made a single yarn of the cotton spun yarn a count of which is 3 to 10. The reason is that the warp comprising synthetic fibers in this second embodiment has larger yarn strength than that of the warp comprising cotton fibers of the above-mentioned the first embodiment.

Here, the reason why a cellulose-based fiber having a small yarn strength is used for the weft is explained. With regard to the physical property of the wrapping net at the time of use, as mentioned above, strength of the knitted fabric in the lengthwise direction is maintained by the warp, and connection in the lateral direction is maintained by the weft. Accordingly, to firmly fix the periphery of the roll bale after wrapping is yarn strength of the warp, so that the weft is not required to have yarn strength as that of the warp.

The reason why the conventional wrapping net uses the same yarns for the warp and the weft is that the manufacture thereof is easy and simple and kitting can be carried out with a low cost. To the contrary, in this second embodiment, a cellulose-based fiber having smaller yarn strength than that of the warp is used for the weft to differentiate the yarn strengths between the warp and the weft. According to this constitution, in the removal operation of the wrapping net after use, when the warp having larger yarn strength is separated from the roll bale, the weft having smaller yarn strength connected thereto is cut.

When the weft is cut as mentioned above, the wrapping net becomes a state of independent chain stitches comprising the warp having larger yarn strength. These independent chain stitches are the same as a rope shape and can be easily removed from the roll bale. According to this constitution, the removal operation of the wrapping net becomes easy, and no accident that an operator erroneously hurt the body by a cutting tool occurs.

On the other hand, many of the wefts cut by the removal operation are removed accompanied by the warp of the independent chain stitches. However, a part of the weft is migrated into the dried pasture or the ensilage of the roll bale as a residue. However, these residues comprise cellulose-based fibers which are the similar components to the hay or the straw, etc., and digested in a body of the livestock whereby there is no bad effect on the livestock. When the roll bale is to be utilized as a fermentation raw material of bioethanol, even when a part of the wrapping net comprising a cellulose-based fiber is entered into a fermentation apparatus by migrated into a fermentation raw material, these become a fermentation raw material of bioethanol by being decomposed similarly to the hay or the straw, etc.

Next, a knitted texture constituting a wrapping net according to this second embodiment is explained. In this second embodiment, the wrapping net is a warp knitted net which is knitted by a warp knitting machine using the warp comprising the above-mentioned synthetic resin-based fiber and the weft comprising a cellulose fiber.

As the knitted texture of the warp knitting, as mentioned above, there are various kinds of knitted textures based on a basic structure such as single denbigh, single cord, single atlas, chain stitch (chain stitching), etc., and in this second embodiment, chain stitch as in the above-mentioned the first embodiment is employed. The wrapping net according to this second embodiment is required to constitute chain stitch (chain stitching) by the warp comprising a synthetic resin-based fiber, and to be made a knitted fabric in which the weft comprising a cellulose fiber is inserted into the chain stitch (chain stitching). This is because in the knitted texture other than the chain stitch, each chain stitch is connected to the warp, and in the removal operation of the wrapping net after use, the connected portion cannot be cut and the removal operation becomes difficult.

Also, as the warp knitting machine, there are a raschel knitting machine, a tricot knitting machine, etc. In this second embodiment, any knitting machine may be used, and in general, a raschel knitting machine is preferably used in the point of productivity, etc. Incidentally, knitting of the wrapping net according to this second embodiment is the same as in the above-mentioned the first embodiment (see FIG. 1), and the explanation of the respective points is omitted.

Further, a knitted fabric density of the warp knitted net in this second embodiment is preferably 0.5 to 20 course/2.54 cm, more preferably 1 to 10 course/2.54 cm, further preferably 1.5 to 3 course/2.54 cm. Moreover, a distance between the stitches of a knitted fabric connected in the lengthwise direction and the stitches adjacent thereto is preferably 10 cm or less, more preferably 5 cm or less. Incidentally, the distance between the stitches and the stitches may be any value if it can maintain physical properties as the wrapping net by adjusting the relation between each fineness and yarn strength of the warp and the weft to be knitted. It is possible to make it, for example, 2.5 cm or less to 0.5 mm or so.

By making the knitted fabric density of the wrapping net 0.5 to 20 course/2.54 cm, and the distance between the stitches connecting in the lengthwise direction of the knitted fabric and the stitches adjacent thereto 10 cm or less, the hay or the straw, etc., cut short does not drop from a network of the wrapping net, and has roughness with a certain extent so that the wrapping net having a small basis (a weight per a unit area) and good economical efficiency can be constituted. According to this constitution, while maintaining the merits of the wrapping net effective for conveying and storage, the removal operation of the wrapping net becomes easy.

Here, when the slit yarns formed from a stretched high density polyethylene (HDPE) film are used for the warp of the wrapping net, elongation of the warp itself is small, so that stretchability of the wrapping net in the warp direction (in the lengthwise direction of the knitted fabric) becomes sometimes small. When the stretchability of the wrapping net is small, operatability when the roll bale is subjected to wrapping and operatability when the wrapping net is removed become difficult. Thus, in this second embodiment, it is preferred to control the shape of the opening portion of the knitted fabric of the wrapping net.

That is, it is preferred that a value of the opening ratio which represents a shape of the opening portion of the knitted fabric of the warp knitted net knitted by a warp knitting machine is made within a predetermined range. Here, the opening ratio of the knitted fabric is represented by the ratio of an opening length (vertical side) in the vertical direction of an opening portion formed by the independent chain stitches comprising the warp and an opening length (lateral side) in the lateral direction of the opening portion formed by the weft. That is, when a distance (lateral side) between the independent chain stitches connecting in the lengthwise direction of the knitted fabric and the other independent chain stitches adjacent thereto is made A, and in the respective independent chain stitches, when a length (vertical side) at the time of elongation of one loop is made B, a value of the opening ratio C of the knitted fabric is represented by C=A/B.

In this second embodiment, as in the above-mentioned the first embodiment, the value of the opening ratio C is preferably within the range of 1 to 5, more preferably within the range of 1 to 3. When the value of the opening ratio C is 1, the shape of the opening portion of the knitted fabric is a square shape. Also, when the value of the opening ratio C is larger than 1, the shape of the opening portion of the knitted fabric becomes a horizontally long rectangular shape in the lengthwise direction of the knitted fabric. By being the shape at the opening portion of the knitted fabric in the state of a square shape or a horizontally long rectangular shape, a degree of freedom of the knitted fabric became large in the warp direction (in the lengthwise direction of the knitted fabric), and stretchability of the wrapping net in the warp direction is improved. According to this constitution, the wrapping operation and the removal operation of the wrapping net become easy.

Next, a manufacturing method for the wrapping net according to this second embodiment is explained. In this second embodiment, as a manufacturing apparatus of the wrapping net, a raschel knitting machine which is the same as in the above-mentioned the first embodiment is preferably used. Incidentally, the constitutions of the respective mechanisms of the raschel knitting machine used in this second embodiment are the same as in the above-mentioned the first embodiment, and the explanation of the respective points is omitted.

Next, the wrapping net according to the second embodiment is specifically explained by Example 3 and Example 4. Incidentally, the present invention is not limited only by the following Examples.

EXAMPLE 3

In the present Example 3, as a warp comprising a synthetic resin-based fiber constituting a wrapping net, 550 decitex of slit yarns comprising a high density polyethylene (HDPE) and having a width of 2.5 mm, a thickness of 25 μm were used. Yarn strength (tensile strength) of this slit yarns was 27 N/1 thread and an elongation (elongation percentage) thereof was 21%. On the other hand, as a weft comprising a cellulose-based fiber constituting the wrapping net, a single yarn (10/-) a count of which is 10 comprising cotton spun yarn was used as the single yarn as such. Yarn strength (tensile strength) of this cotton single yarn (10/-) was 13 N/1 thread. Incidentally, measurements of the tensile strength-elongation of the yarn (tensile strength and elongation percentage) were carried out according to JIS-L1013.

For knitting of the wrapping net in the present Example 3, a raschel knitting machine was used in the same manner as in the above-mentioned Example 1, and a wrapping net of a knitted texture shown in the above-mentioned FIG. 1 was knitted. A knitted fabric density of the wrapping net knitted in the present Example 3 was 2 course/2.54 cm, and a distance with the chain stitch (wale) adjacent to the chain stitch (wale) connecting to the knitted fabric in the lengthwise direction was 2.5 cm. Also, a basis weight of the wrapping net was 10 g/m$^2$.

The wrapping net according to the present Example 3 was knitted by the knitted texture shown in FIG. 1, each chain stitch (wale) was so formed by running the slit yarns comprising a high density polyethylene (HDPE) which were the warp three times (1.5 round trips) per one loop, and thus, strength (tensile strength) per one chain stitch was 81 N/1 thread corresponding to about 3-fold of the yarn strength of the slit yarns.

On the other hand, one weft responds to one chain stitch (see FIG. 1). From this constitution, one weft with 13 N/1 thread responds per one chain stitch with 81 N/1 thread, so that difference in yarn strengths between the warp and the weft becomes larger. According to this constitution, when the wrapping net after use is to be removed, the weft having weak yarn strength is predominantly cut, whereby the removal operation of the wrapping net becomes easy. Accordingly, no accident that an operator erroneously hurt the body by a cutting tool occurs.

Also, a knitted fabric density of the wrapping net according to the present Example 3 was 2 course/2.54 cm as mentioned above, and a distance with the chain stitch (wale) adjacent to the chain stitch (wale) connecting to the knitted fabric in the lengthwise direction was 2.5 cm. From the above constitution, a value of the opening ratio C which represents a shape of an opening portion of the wrapping net was as follows.

First, a distance (lateral side) between the chain stitches (wale) and the chain stitches (wale) adjacent thereto was A=2.5 cm, and a length (vertical side) at the time of elongation of one loop was B=2.54 cm/2=1.27 cm. Accordingly, the opening ratio of the wrapping net according to the present Example 3 was C=A/B=2.5/1.27=2. As a result, a shape of the opening portion of the wrapping net became a horizontally long rectangular shape in the lengthwise direction of the wrapping net, a degree of freedom of the knitted fabric became large in the warp direction (in the lengthwise direction of the knitted fabric), and stretchability of the wrapping net in the warp direction was good. According to this constitution, the wrapping operation and the removal operation of the wrapping net become easy.

By using the thus obtained wrapping net (a width: 1 m, a basis weight of 10 g/m$^2$) of the present Example 3, wrapping of the roll bale was actually carried out by using a wrapping machine. As a result, it could endure high tension of the apparatus which was similar to that of the conventional wrapping net (a high density polyethylene was used for both of the warp and the weft). Also, the surface of the roll bale subjected to wrapping has been wound with sufficiently hard, which could be satisfied practically. According to these constitutions, the merits of the wrapping net effective for conveying and storage can be maintained as in the conventional wrapping net.

Next, a removal operation of the wrapping net was carried out. In the wrapping net of the present Example 3, when the warp having large yarn strength is separated from the roll bale, the weft having small yarn strength connecting thereto was suitably cut. Therefore, the wrapping net became a state of a chain stitch comprising a warp having large yarn strength, and could be easily removed from the roll bale. As a result, the removal operation of the wrapping net becomes easy, and no accident that an operator erroneously hurt the body by a cutting tool occurs.

On the other hand, many of the weft cut by the removal operation were removed accompanied by the chain stitch comprising the warp, and the residue of the weft was substantially not migrated into the hay or the straw, etc., of the roll bale. However, even if the residue thereof is migrated into the hay or the straw, etc., the livestock can digest these, or they are utilized as a part of a fermentation raw material for bioethanol fermentation.

EXAMPLE 4

In the present Example 4, as a warp comprising a synthetic resin-based fiber constituting a wrapping net, 1,000 decitex of slit yarns comprising a polylactic acid (PLA)-based biodegradable resin and having a width of 4 mm and a thickness of 30 μm were used. Yarn strength (tensile strength) of this slit yarns was 18 N/1 thread. On the other hand, as a weft comprising a cellulose-based fiber constituting the wrapping net, a single yarn (10/-) a count of which is 10 comprising cotton spun yarn which is the same in above-mentioned Example 3 was used as the single yarn as such. Yarn strength (tensile strength) of this cotton single yarn (10/-) was 13 N/1 thread. Incidentally, measurements of the tensile strength-elongation of the yarn (tensile strength and elongation percentage) were carried out according to JIS-L1013.

For knitting of the wrapping net in the present Example 4, a raschel knitting machine was used in the same manner as in the above-mentioned Example 1, and a wrapping net of a knitted texture shown in the above-mentioned FIG. 1 was knitted. A knitted fabric density of the wrapping net knitted in the present Example 4 was 2 course/2.54 cm, and a distance with the chain stitch (wale) adjacent to the chain stitch (wale) connecting to the knitted fabric in the lengthwise direction was 2.5 cm. Also, a basis weight of the wrapping net was 10 g/m$^2$.

The wrapping net according to the present Example 4 was knitted by the knitted texture shown in FIG. 1, each chain stitch (wale) was so formed by running the slit yarns comprising a polylactic acid (PLA)-based biodegradable resin which were the warp three times (1.5 round trips) per one loop, and thus, strength (tensile strength) per one chain stitch was 54 N/1 thread corresponding to about 3-fold of the yarn strength of the slit yarns.

On the other hand, one weft responds to one chain stitch (see FIG. 1). From this constitution, one weft with 13 N/1 thread responds per one chain stitch with 54 N/1 thread, so that difference in yarn strengths between the warp and the weft becomes larger. According to this constitution, when the wrapping net after use is to be removed, the weft having weak yarn strength is predominantly cut, whereby the removal operation of the wrapping net becomes easy. Accordingly, no accident that an operator erroneously hurt the body by a cutting tool occurs.

Also, a knitted fabric density of the wrapping net according to the present Example 4 was 2 course/2.54 cm as mentioned above, and a distance with the chain stitch (wale) adjacent to the chain stitch (wale) connecting to the knitted fabric in the lengthwise direction was 2.5 cm. From the above constitution, a value of the opening ratio C which represents a shape of an opening portion of the wrapping net was as follows.

First, a distance (lateral side) between the chain stitches (wale) and the chain stitches (wale) adjacent thereto was A=2.5 cm, and a length (vertical side) at the time of elongation of one loop was B=2.54 cm/2=1.27 cm. Accordingly, the opening ratio of the wrapping net according to the present Example 4 was C=A/B=2.5/1.27=2. As a result, a shape of the opening portion of the wrapping net became a horizontally long rectangular shape in the lengthwise direction of the wrapping net, a degree of freedom of the knitted fabric became large in the warp direction (in the lengthwise direction of the knitted fabric), and stretchability of the wrapping net in the warp direction was good. According to this constitution, the wrapping operation and the removal operation of the wrapping net become easy.

By using the thus obtained wrapping net (a width: 1 m, a basis weight of 10 g/m$^2$) of the present Example 4, wrapping of the roll bale was actually carried out by using a wrapping machine. As a result, it could endure high tension of the apparatus which was similar to that of the conventional wrapping net (a high density polyethylene was used for both of the warp and the weft). Also, the surface of the roll bale subjected to wrapping has been wound with sufficiently hard, which could be satisfied practically. According to these constitutions, the merits of the wrapping net effective for conveying and storage can be maintained as in the conventional wrapping net.

Next, a removal operation of the wrapping net was carried out. In the wrapping net of the present Example 4, when the warp having large yarn strength is separated from the roll bale, the weft having small yarn strength connecting thereto was suitably cut. Therefore, the wrapping net became a state of a chain stitch comprising a warp having large yarn strength, and could be easily removed from the roll bale. As a result, the removal operation of the wrapping net becomes easy, and no accident that an operator erroneously hurt the body by a cutting tool occurs.

On the other hand, many of the weft cut by the removal operation were removed accompanied by the chain stitch comprising the warp, and the residue of the weft was substantially not migrated into the hay or the straw, etc., of the roll bale. However, even if the residue thereof is migrated into the hay or the straw, etc., the livestock can digest these, or they are utilized as a part of a fermentation raw material for bioethanol fermentation.

Further, in the wrapping net of the present Example 4, the warp comprises a polylactic acid (PLA)-based biodegradable resin and the weft comprises a natural fiber of cotton fibers. Accordingly, the wrapping film removed by the removal operation can be naturally decomposed by burying in soil of a farm. Accordingly, the wrapping net of Example 4 can be easily disposed.

As explained above, according to the present invention, it can provide a wrapping net which maintains the merits by wrapping with a wrapping net effective for conveying and storage, and, in which a removal operation of the wrapping net is easy, even when a residue of the wrapping net is migrated into a feed or a fermentation raw material, an effect on the livestock is a little or no trouble is caused in a fermentation apparatus. The present invention can further provide a manufacturing method for these wrapping nets.

Incidentally, for carrying out the present invention, it is not limited to the above-mentioned respective Examples and the following various modified examples may be mentioned.

(1) In the above-mentioned Example 1, as the cellulose-based fiber constituting the warp of the wrapping net, doubled yarns (10//2s) which uses two single yarns (10/-) a count of which is 10 comprising cotton spun yarn by arranging in parallel without twisting were used, but the invention is not limited thereto, and cotton spun yarns with thick count may be used with the single yarn as such, or doubled yarns in which three or more cotton spun yarns with medium count to thick count are used by arranging in parallel without twisting may be used. Or else, yarns comprising cellulose-based fibers other than the cotton spun yarns may be used.

(2) In the above-mentioned Example 2, as the cellulose-based fiber constituting the warp of the wrapping net, two-plied yarns (10/2) of plied yarns in which two cotton spun yarns (10/-) a count of which is 10 have been aligned in parallel and twisted were used, but the invention is not limited thereto, and cotton spun yarns with thick count may be used with the single yarn as such, or the three-plied yarn in which three cotton spun yarns are aligned in parallel may be used. Or else, yarns comprising a cellulose-based fiber other than the cotton spun yarn may be used.

(3) In the above-mentioned Example 1 and Example 2, as the cellulose-based fiber constituting the weft of the wrapping net, cotton spun yarns a count of which is 20 (20/-) were used, but the invention is not limited thereto, and cotton spun yarns with the other counts or yarns comprising a cellulose-based fiber other than the cotton spun yarn may be used.

(4) In the above-mentioned Example 1 and Example 2, the wrapping net was removed from the roll bale, but the invention is not limited thereto, and the wrapping net wound to the roll bale is cut including both of the warp and the weft, and whole amount of the wrapping net may be made a feed for the livestock with the hay or the straw, etc., or whole amount of the wrapping net may be utilized as a part of a fermentation raw material of bioethanol fermentation.

(5) In the above-mentioned Example 3 and Example 4, as the synthetic resin-based fiber constituting the warp of the wrapping net, a high density polyethylene (HDPE) and a polylactic acid (PLA) were used, but the invention is not limited thereto, but a low density polyethylene (LDPE) or the other biodegradable resins may be used.

(6) In the above-mentioned Example 3 and Example 4, as the cellulose-based fiber constituting the weft of the wrapping net, cotton spun yarns a count of which is 10 (10/-) were used, but the invention is not limited thereto, cotton spun yarns with the other counts or the other cellulose-based fiber may be used.

(7) In the above-mentioned respective Examples, as the knitted fabric density of the wrapping net, it is 2 course/2.54 cm, and a distance between the chain stitch connecting to the knitted fabric in the lengthwise direction and the chain stitch adjacent thereto is 2.5 cm were employed, but the invention is not limited thereto, and roughness of the knitted fabric may be adjusted depending on the cut length of the hay or the straw.

(8) In the above-mentioned respective Examples, a basis weight of the wrapping net was about 10 to 15 g/m$^2$ or so, but the invention is not limited thereto, and it may be optionally adjusted by the yarn strength or stretchability of the warp and the weft to be used.

EXPLANATION OF REFERENCE NUMERALS

1 . . . Warf, 2 . . . Weft, 10 . . . Knitted fabric, 20 . . . Loop, 30 . . . Wale, 40 . . . Course, A . . . Example 1 (Wrapping net comprising cotton fibers), B . . . Rice for feed (Kusanohoshi foliage), C . . . Rice for feed (Tachisuzuka foliage).

The invention claimed is:

1. A wrapping net which comprises warp yarn groups comprising a cellulose-based fiber aligned in parallel in a lengthwise direction of a knitted fabric form a plural number of independent chain stitches by continuous loops in the lengthwise direction of the knitted fabric, respectively, and each loop of the independent chain stitches is connected to other loops of other independent chain stitches by weft comprising a cellulose-based fiber to form a knitted fabric wherein yarn tensile strength of the warp is greater than yarn tensile strength of the weft.

2. The wrapping net according to claim 1, wherein the warp is doubled yarns in which two or more yarns of single yarns which are staple fiber spun yarn a count of which is 5 to 20 comprising cotton fibers are aligned in parallel without twisting the yarns, and the weft is a single yarn of a staple fiber spun yarn a count of which is 10 to 30 comprising cotton fibers.

3. The wrapping net according to claim 1, wherein the warp is plied yarns in which two or more yarns of single yarns which are staple fiber spun yarn a count of which is 5 to 20 comprising cotton fibers are twisted, and the weft is a single yarn of a staple fiber spun yarn a count of which is 10 to 30 comprising cotton fibers.

4. A wrapping net which comprises warp yarn groups comprising a synthetic resin-based fiber aligned in parallel in a lengthwise direction of a knitted fabric form a plural number of independent chain stitches by continuous loops in the lengthwise direction of the knitted fabric, respectively, each loop of the independent chain stitches is connected to other loops of other independent chain stitches by weft comprising a cellulose-based fiber to form a knitted fabric, and yarn tensile strength of the warp is greater than yarn tensile strength of the weft.

5. The wrapping net according to claim 4, wherein the warp is a slit yarn having a single yarn fineness of 200 to 2500 decitex in which a synthetic resin film is slit, and the weft is staple fiber spun yarns a count of which is 3 to 30 and comprises cotton fibers.

6. The wrapping net according to claim 5, wherein the warp comprises a biodegradable resin.

7. The wrapping net according to any one of claims 1 or 2 to 6, wherein the weft is inserted into the independent chain stitches at entangling points of a needle loop of the loops constituting the independent chain stitches by extending upward from a lower portion in the lengthwise direction of the knitted fabric and a sinker loop which is right above the loop of the above loop, and further, inserted into the other independent chain stitches at entangling points of a needle loop of the loops constituting the independent chain stitches by extending upward and the other independent chain stitches and a sinker loop which is right above the loop of the above loop, whereby the independent chain stitches and the other independent chain stitches adjacent thereto are connected to knit a knitted fabric.

8. The wrapping net according to claim 7, wherein the net is so knitted that a knitted fabric density is 0.5 to 20 course/2.54 cm and a distance between the independent chain stitches connected in the lengthwise direction of a knitted fabric and the other independent chain stitches adjacent thereto is 10 cm or less by a warp knitting machine.

9. The wrapping net according to claim 7, wherein when a distance between the independent chain stitches of the knitted fabric connected in the lengthwise direction and the other independent chain stitches adjacent thereto is made A, and a length of a loop at elongation in respective independent chain stitches is made B, a value of an opening ratio C of the knitted fabric represented by C=AB is within a range of 1 to 5.

* * * * *